US011913677B2

(12) United States Patent
Fabrizio

(10) Patent No.: US 11,913,677 B2
(45) Date of Patent: Feb. 27, 2024

(54) ELECTRIC TANKLESS WATER HEATER WITH INTEGRAL LEAK DETECTION SYSTEM

(71) Applicant: Chronomite Laboratories, Inc., City of Industry, CA (US)

(72) Inventor: Edward V. Fabrizio, Rancho Cucamonga, CA (US)

(73) Assignee: Chronomite Laboratories, Inc., City of Industry, CA (US)

( * ) Notice: Subject to any disclaimer, the term of this patent is extended or adjusted under 35 U.S.C. 154(b) by 0 days.

(21) Appl. No.: 17/962,906

(22) Filed: Oct. 10, 2022

(65) Prior Publication Data

US 2023/0119604 A1 Apr. 20, 2023

Related U.S. Application Data

(60) Provisional application No. 63/255,580, filed on Oct. 14, 2021.

(51) Int. Cl.

| | |
|---|---|
| ***F24H 15/12*** | (2022.01) |
| ***F24H 15/238*** | (2022.01) |
| ***F24H 15/395*** | (2022.01) |
| ***F24H 9/17*** | (2022.01) |
| ***F24H 15/305*** | (2022.01) |
| ***F24H 1/10*** | (2022.01) |

(52) U.S. Cl.

CPC ..... *F24H 15/12* (2022.01); *F24H 1/102* (2013.01); *F24H 9/17* (2022.01); *F24H 15/238* (2022.01); *F24H 15/305* (2022.01); *F24H 15/395* (2022.01)

(58) Field of Classification Search

CPC ..... F24H 15/12; F24H 15/305; F24H 15/395; F24H 15/238; F24H 9/17; F24H 1/102; F24H 1/10; F24H 9/2028; F24H 9/2007

See application file for complete search history.

(56) References Cited

U.S. PATENT DOCUMENTS

| | | | | |
|---|---|---|---|---|
| 4,805,662 A * | 2/1989 | Moody | F24H 9/2021 | 126/388.1 |
| 6,701,069 B1 * | 3/2004 | Cezayirli | F24H 1/102 | 392/494 |
| 7,561,057 B2 * | 7/2009 | Kates | G01M 3/186 | 340/622 |

(Continued)

*Primary Examiner* — Edelmira Bosques
*Assistant Examiner* — Brett Peterson Mallon
(74) *Attorney, Agent, or Firm* — Honigman LLP; Eric J. Sosenko; Jonathan P. O'Brien

(57) ABSTRACT

A tankless water heater for heating a continuous supply of water. The tankless water heater includes a housing, a water inlet and outlet ports, a heater assembly located within the housing and defining a water flow path having a heating element located therein and being coupled to the water inlet and outlet ports. A flow sensing device measures the water's flow condition between the water inlet and outlet ports. The water heater further includes a leak detection system having a water collection area defined by a portion of the housing, a water sensor configured to detect the presence of water in the collection area and being coupled to a water stoppage valve that is moveable between an open position and a closed position in response to a signal from the water sensor indicating water being present in the water collection area.

18 Claims, 3 Drawing Sheets

(56) References Cited

U.S. PATENT DOCUMENTS

| | | | | |
|---|---|---|---|---|
| 8,319,626 | B1 * | 11/2012 | Cantolino | F24H 9/17<br>122/13.01 |
| 9,916,748 | B1 * | 3/2018 | Yadvish | G01M 3/40 |
| 10,670,300 | B2 | 6/2020 | Fabrizio | |
| 10,830,492 | B2 | 11/2020 | Fabrizio | |
| 2006/0222349 | A1 * | 10/2006 | Sturm | F24H 15/156<br>392/463 |
| 2010/0212752 | A1 * | 8/2010 | Fima | F24H 9/2007<br>137/87.03 |

* cited by examiner

ELECTRIC TANKLESS WATER HEATER WITH INTEGRAL LEAK DETECTION SYSTEM

CROSS REFERENCE TO RELATED APPLICATION

This application is a non-provisional application of U.S. application No. 63/255,580 filed Oct. 14, 2021, the entire contents of which is herein incorporated by reference.

BACKGROUND OF THE INVENTION

1. Field of the Invention

The present disclosure generally relates to an electric tankless water heater. Specifically, the present disclosure relates to an electric tankless water heater system having an integral leak detection system.

2. Description of Related Art

Tankless water heaters are used to increase the temperature of water supplied from a water source. Such water heaters include an inlet, an outlet, a conduit for transporting water from the inlet to the outlet, and at least one heater element for increasing the temperature of the water prior to the water exiting the outlet.

In order to achieve a desired temperature of water exiting the outlet, it is often necessary to control the electrical energy supplied to one or more heater elements. The heating element(s) must be of sufficient wattage to maintain the desired outlet water temperature at the maximum flow rate of the tankless water heater. Obviously, if the wattage is insufficient, the temperature of water provided at the maximum flow rate will not be the desired temperature. However, with high wattage heating element(s), supplying hot water at very low flow rates is not possible without the risk of overheating the tankless water heater.

One such electric tankless water heater is seen in U.S. Pat. No. 10,830,492, which is commonly owned by the assignee of the present application and which is herein incorporated by reference in its entirety.

While existing electric tankless water heaters have proven acceptable for their intended purpose, a continuous need for improvement remains in the relevant art.

SUMMARY

In one aspect, the invention provides a tankless water heater, for heating a continuous supply of water, that includes a leak detection system.

In another aspect, the invention provides a tankless water heater that includes a housing defining an enclosure; a water inlet port; a water outlet port; a heater assembly located within the housing, the heater assembly including a body defining a water flow path coupled to the water inlet port and the water outlet port; at least one heating element located within the water flow path; a flow sensing device configured to measure a flow condition of water between the water inlet port and the water outlet port; and a leak detection system. The leak detection system including a water collection area defined by a portion of the housing, a water sensor positioned adjacent to the water collection area and configured to detect the presence of water therein. The water sensor is coupled to a water stoppage valve that is moveable between an open position and a closed position. In the open position, the water stoppage valve permits the flow of water from the inlet port to the outlet port. In the closed position, the water stoppage valve prevents the flow of water from the inlet port to the outlet port. The water stoppage valve is configured to move from the open position to the closed position in response to a signal from the water sensor indicating that water is present in the water collection area.

In another aspect, the water stoppage valve is a solenoid valve.

In a further aspect, the water sensor is one of an optical level switch, a capacitance level sensor, an ultrasonic level sensor, a conductivity level sensor and a float switch.

In an additional aspect, the water collection area is defined by a bottom wall of the housing In yet another aspect, the water collection area is defined by an upwardly concave portion of the housing.

In a further aspect, the water sensor is positioned centrally within the water collection area.

In an additional aspect, the water stoppage valve is a solenoid valve.

In another aspect, the solenoid valve is biased in the open position.

In still a further aspect, a process control board is coupled to the water sensor and water stoppage valve and is configured to de-energize the heating element upon generation of a signal by the water sensor indicating water being present in the water collection area.

In an additional aspect, the process control board is configured to prevent energizing of the heating elements until a reset condition is established.

In still another aspect, a reset button is coupled to the process control board and upon activation of the reset button the process control board is configured to establish the reset condition.

In a further aspect, the process control board is configured to provide a status output to a building management system.

In an additional aspect, the status output includes dry and wet/leak status indication.

In another aspect, the status output includes at least one of dry and wet/leak status indication and heater on and off status indication.

In yet a further aspect, the status output includes at least one of water temperature status and water pressure status.

In an additional aspect, an audible alarm is coupled to the water sensor and water stoppage valve and is configured to produce an audible signal upon generation of a signal by the water sensor indicating water is present in the water collection area.

In another aspect, a step down transformer is provided in the tankless water heater.

In a further aspect, the step down transformer is coupled to the water stoppage valve.

Further objects, features and advantages of the present invention will become readily apparent to persons skilled in the art after review of the following description, with reference to the drawings, and the claims that are appended to and form a part of this specification.

BRIEF DESCRIPTION OF THE DRAWINGS

The drawings described herein are for illustrative purposes of selected configurations and not all possible implementations of the present invention. Accordingly, the drawings are not intended to limit the scope of the present disclosure.

Corresponding reference numerals indicate corresponding parts throughout the drawings.

DETAILED DESCRIPTION

An example configuration will now be described with reference to the accompanying drawings. Specific details are set forth such as examples of specific components, devices, and methods, to provide a thorough understanding of the present disclosure. It will be apparent to those of ordinary skill in the art that specific details need not be employed, that example configurations may be embodied in many different forms, and that the specific details and the example configurations should not be construed to limit the scope of the disclosure.

Figure 1:
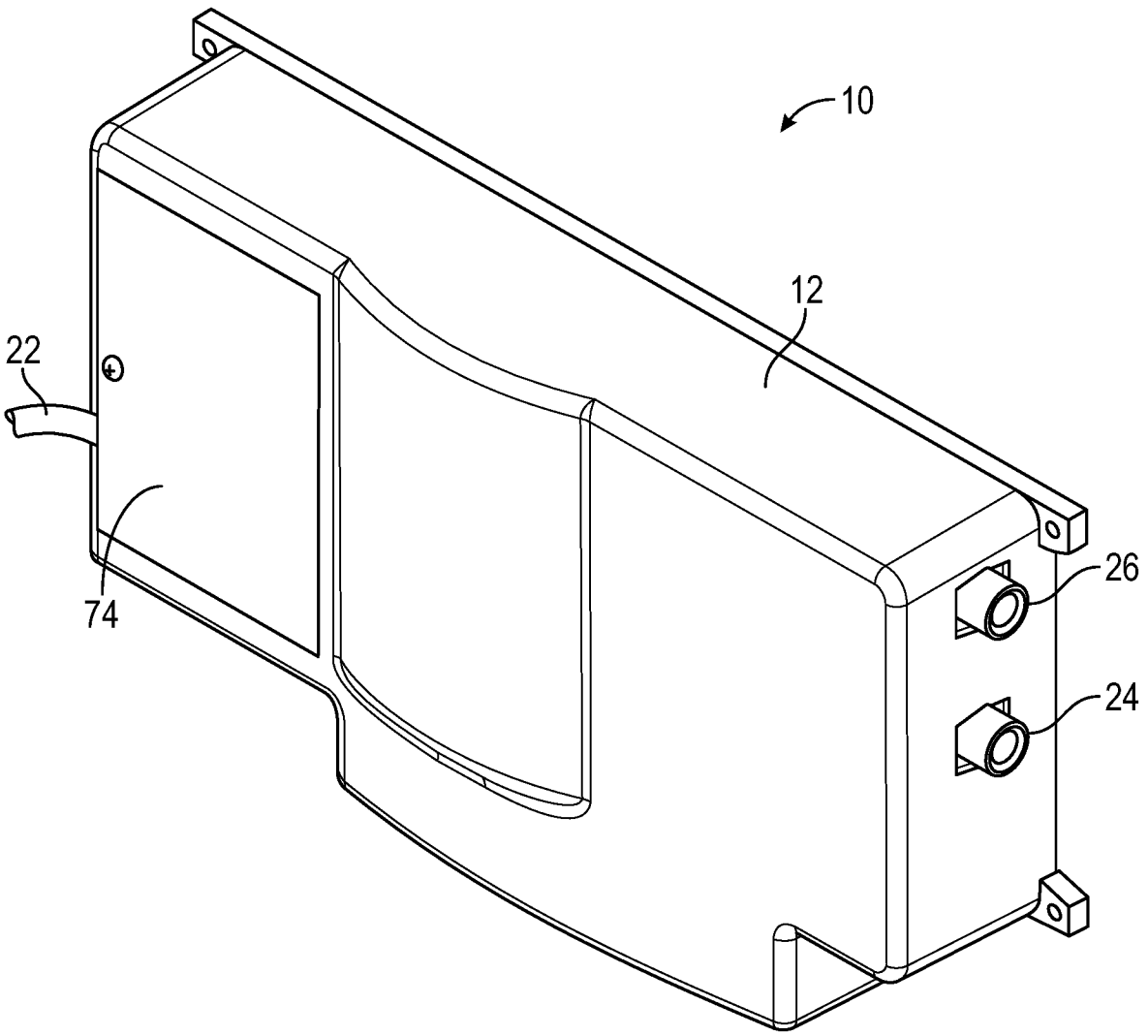
FIG. 1 is a perspective view of an electric tankless water heater incorporating the principles of the present disclosure.

Referring now to the drawings, an electric tankless water heater (ETWH) embodying the principles of the present disclosure is generally illustrated in FIG. 1 and designated at 10. In this regard, while the tankless water heater 10 is generally shown and described herein as being a heater for a continuous water supply, it will be appreciated that the tankless water heater 10 may be used for heating a continuous or intermittent supply of other fluid(s) within the scope of the present disclosure.

As illustrated, the tankless water heater 10 includes as its principal components a housing 12, a heater assembly 14, a temperature sensor 16, a flow sensor 18, process control board 20, and a power supply 22. Water is provided to the heater 10 via a cold water inlet 24 and from the heater 10 via a hot water outlet 26. The water inlet 24 and outlet 26 are in turn coupled to a manifold 28 that directed the flow of water to and from the heater assembly 14. Accordingly, from the water inlet 24, a flow path 30 is defined through the manifold 28 to the heater assembly 14, back to the manifold 28 and finally to the water outlet 26.

Figure 2:
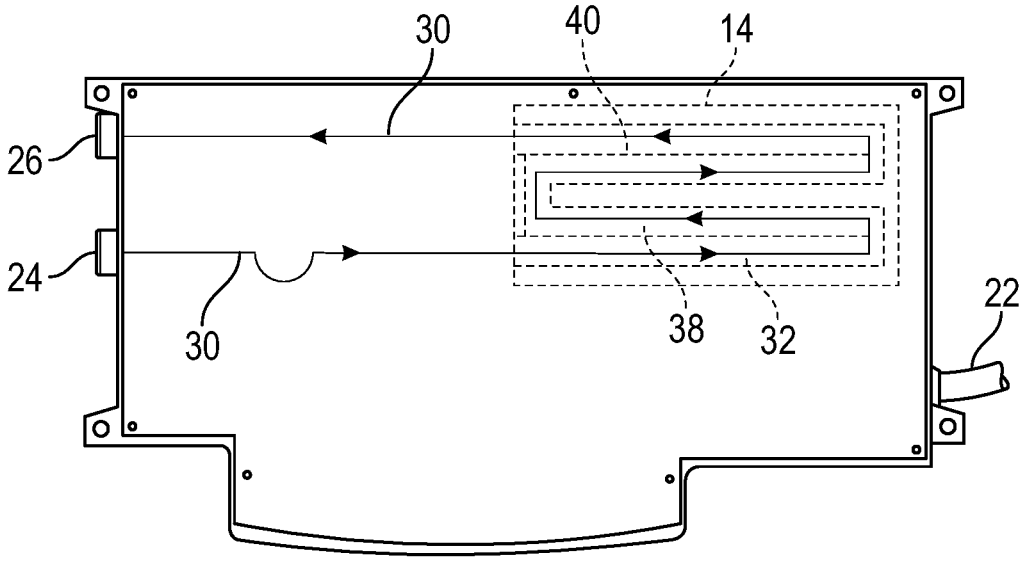
FIG. 2 is rear view of the electric tankless water heater seen in FIG. 1.

As illustrated in FIG. 2, within the heater assembly 14, the flow path 30 follows a reverse bend or serpentine shape defined by a heating chamber 32. While not seen in FIG. 2, two heating elements 34, 36 are located in series with one another within the two inner legs 38, 40 of the heating chamber 32.

While illustrated as having a serpentine shape, the heating chamber 32 may have alternate shapes and configurations depending on the particular application, as well as the overall size and shape of the heater assembly 14. Furthermore, the heating chamber 32 preferably defines a constant diameter along the flow path 30, but the diameter may vary.

The first heating element 34 is disposed in the heating chamber 32 and is provided with a first wattage. The wattage of the first heating element 34 will depend on the particular design of the tankless water heater 10. Generally, the wattage may be between 720 Watts and 8550 Watts. The second heating element 36 is also disposed in the heating chamber 32 and may operate up to and including a second wattage. Like the first heating element 34, the wattage of the second heating element 36 will also depend on the particular design of the tankless water heater 10. The second wattage may be the same as the first wattage or different from the first wattage. Generally, its wattage will also be between 720 Watts and 8550 Watts.

The first and second heating elements 34, 36 are preferably formed of a resistive heating material. In this regard, the first and/or second heating elements 34, 36 may be formed from an electrically conductive material, such as a metallic material (e.g., molybdenum, tungsten, tantalum, niobium, and alloys thereof) through which electrical current may flow and provide resistive heat to the heater assembly 14. In some implementations, one or both of the first and second heating elements 34, 36 may be sheathless. In this regard, the first and/or second heating elements 34, 36 may omit sheathing and coatings, such as a ceramic coating covered by a stainless steel sheath or other coating and/or cover material. The first and/or second heating elements 34, 36, including the resistive heating material forming a part thereof, is directly disposed within the heating chamber 32 and directly in contact with the fluid flowing through the heating chamber 32.

Figure 3:
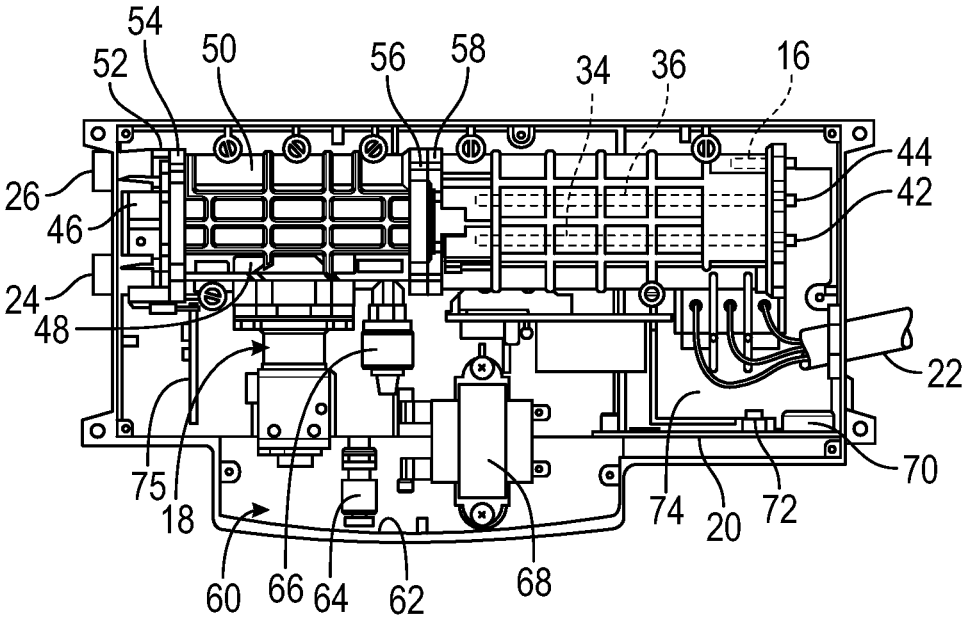
FIG. 3 is rear elevational view of the electric tankless water heater seen in FIGS. 1 and 2.

With reference to FIG. 3, the temperature sensor 16 measures the temperature of the fluid flowing through the heating chamber 32 of the heater assembly 14, and is in communication with the process control board 20. In this regard, the temperature sensor 16 is preferably provided in the heater assembly 14 downstream of the heating elements 34, 36, or proximate the water outlet 26, to measure the temperature of the fluid as it is about to exit the water heater 10.

The solenoid valve 18 is located along the flow path 30 of the heater assembly 14, and is also in communication with the process control board 20. The solenoid valve 18 is positioned along the flow path 32, or more particularly, as shown, proximate the water inlet 24 in the manifold 28 to determine the flow condition of the water flowing along the flow path 32. As will be explained in more detail below, the solenoid valve 18 communicates the flow condition to the process control board 20. As used herein, the flow condition is the flow rate (e.g., gallons per minute) of the fluid flowing along the flow path 32, but may optionally include other parameters of the fluid flow.

The process control board 20 is coupled to, or otherwise in communication with, the first heating element 34, the second heating element 36, the temperature sensor 16, the solenoid valve 18 and a flow sensor. In this regard, the process control board 20 uses signals received from the temperature sensor 16 and/or the flow sensor to control the operation of the tankless water heater 10. For example, during operation of the tankless water heater 10, and in response to signals received from the temperature sensor 16 and/or the flow sensor, the process control board 20 may regulate the amount of electrical current flowing through the first and second heating elements 34, 36.

Figure 4:
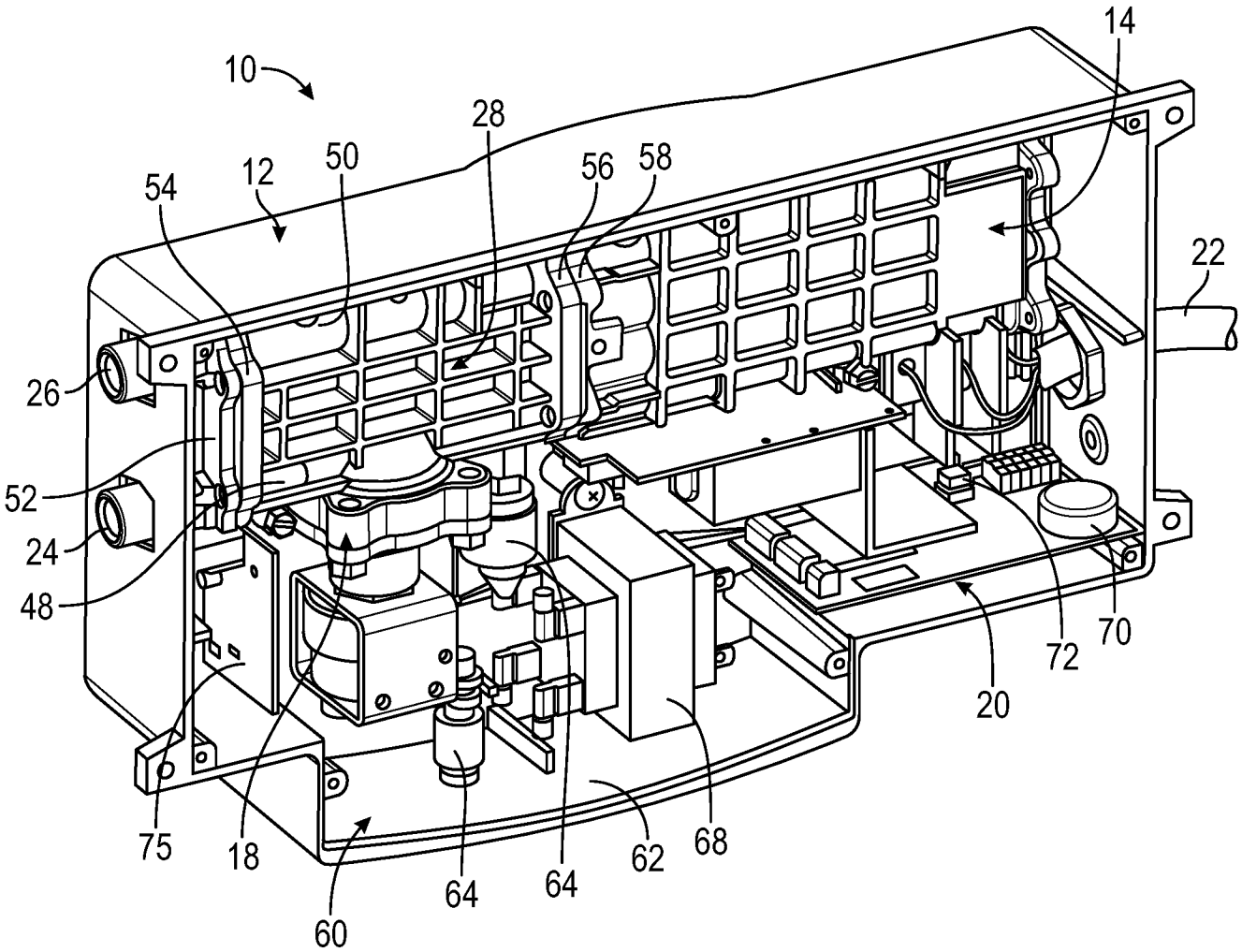
FIG. 4 is rear perspective view of the electric tankless water heater seen in FIGS. 1 and 2.

With reference to FIGS. 3 and 4, the power supply 22 may be provided as an alternating current source, such as an 110 v outlet (or higher voltage), a generator or a direct current source, such as a battery, for example. As seen in FIG. 3, the first heater element 34 is coupled to a first pole 42 and is coupled to the triac control board 75 via the first pole 42, such that electrical power can be selectively transmitted by the triac control board 75, through operation of relays, for example, to the first pole 42 and from the first pole 42 to the first heater element 34. The second heater element 36 may connected in series with the opposing end of the first heater element 34 by a coupling (not shown) and the opposing end of the second heating element 36 is coupled to the process control board 20 via a second pole 44. The triac control board 75 is a simple control circuit designed to, upon detection of a flow condition, energize the first and second heating elements 34, 36 to provide heated water to the outlet 26 at a predetermined temperature. Such types of triac control boards 75 are well known and within the skill of those in the field of the present invention and, therefore, are not further described herein.

The flow sensor utilized in accordance with the principles of the present invention may be any type of flow sensor configured to sense low flow conditions. As such, the flow sensor may be an electrical, optical or mechanical type of flow sensor 18. Preferably, the flow sensor is highly sensitive and capable of sensing ultra-low flows, flows that are above 0.0 gallons per minute (GPM) and up to 0.4 GPM, and more preferably in the range of about 0.1 to 0.3 GPM.

In one embodiment of the flow sensor, a portion of the housing of the heater assembly 14 forms part of the flow sensor and cooperates with a diaphragm to define a sealed pressure chamber. The diaphragm is retained over the pressure chamber by a cover. Retained in this manner, the diaphragm extends completely about the perimeter of the pressure chamber so as to seal off and isolate a volume of air within the pressure chamber. Preferably, the diaphragm is flexible and formed of rubber. The cover includes a recess that cooperates with the diaphragm to define a sensing chamber on the side of the diaphragm opposite from the pressure chamber. The sensing chamber is in fluid communication with the water traversing the flow path 30 through the heating chamber 32. In one construction, the sensing chamber may be in communication with the flow path 30 via a port, defined in part by the cover and in part by the housing of the heater assembly 14. Alternatively, the sensing chamber may be in communication with the flow path 30 with the port being defined in part by the housing of the heater assembly 14 and in part by a recessed relief area defined about the perimeter of the recess in the cover.

Also provided in the sensing chamber is one end of a switch actuator. The switch actuator includes an actuator rod with a proximal end in the sensing chamber and a distal end outside of the chamber and the cover. The proximal end of the actuation rod is provided with an actuation knob that is preferably centrally located within the sensing chamber. Where the actuation rod extends through the cover, the actuation rod passes through a pivot that forms a fluid tight seal with the cover and the actuation rod. The actuation rod is biased such that the proximal end, or more specifically the actuation knob, is biased toward the diaphragm. Biasing may be achieved by a biasing member, such as a coil spring. The pivot allows the actuation rod to pivot in such a manner that when the proximal end of the actuation rod moves toward the cover, the distal end of the actuation rod moves in an opposite direction, which causes engagement with and activation of a switch. Preferably, the switch is proportional in its operation and provides varying signals to the control circuitry depending on the degree of activation by the activation rod.

The flow sensor may additionally include a rigid activation plate provided in the sensing chamber over the diaphragm to engage and interact with the activation knob on the proximal end of the activation rod. The activation plate provides a rigid, smooth and durable surface toward which the activation knob may be biased and over which the activation knob may engage and slide.

During operation of the flow sensor, as the flowing fluid, such as water, moves along the flow path 30 past the port, the flow of liquid draws on the sensing chamber and induces a negative pressure in the sensing chamber relative to the pressure chamber. As a result, the diaphragm is biased/caused to deform toward the cover. This in turn causes a similar movement of the activation plate and the proximal end of the activation rod. As proximal end of the activation rod moves toward the cover, the distal end of the activation rod moves to engage the switch. A flow sensor according to the above is disclosed in U.S. Pat. No. 10,670,300, which is herein incorporated by reference in its entirety.

The water inlet and outlet 24, 26 are seen formed as an integral inlet/outlet (I/O) unit 46 and each defines a separate inlet and outlet passageway through the I/O unit 46. The I/O unit 46 is mounted to the manifold 28, which similarly has separate inlet and outlet passageways/conduits 48, 50 defined therethrough, as seen in FIGS. 3 and 4 where the solenoid valve 18 is coupled to the inlet conduit 48. To facilitate mounting of the I/O unit 46 to the manifold 28, each component is respectfully provided with a flat mounting flange 52, 54 that allows the two components to be directed mounted to one another. The one of the mounting flanges may further be provided with a recess or groove for receiving a gasket or O-ring positioned about the inlet and outlet passageways 48, 50, either individually or collectively. The mounting flanges 52, 54 are secured together by fasteners, such as stainless steel nut and bolt fasteners.

Similarly, the manifold 28 and the heater assembly 14 are provided with flat mounting flanges 56, 58, respectively, to facilitate direct mounting of the manifold 28 to the heater assembly 14 and the connecting the passageways defining the flow path 30 The mounting flanges 56, 58 are preferably secured together by stainless steel nut and bolt fasteners, or other fasteners, one of the mounting flanges 56, 58 may further be provided with a recess or groove for receiving a gasket or O-ring positioned about the inlet and outlet passageways.

While the various engagements between the mounting flanges 52, 54, 56, 58 are intended to be fluid tight, it remains possible that at some point in time, the integrity of the engagements might deteriorate and a leak may develop. For this reason, the electric tankless water heater 10 is provided with an integral leak detection system 60.

The leak detection system 60 includes a portion of the housing 12 being formed as a collection pan 62 within which is located a mechanical float 64. The pan 62 is formed as the lowermost section of the housing 12 and defines an upwardly or inwardly concave portion of the housing 12. Generally, the pan 62 is located below the junctures of the mounting flanges 52, 54, 56, 58, and beneath the heater assembly 14, which may also be the source of a possible fluid leak since it is a separate unit mounted to the manifold 28.

The float 64 defines a switch that is coupled to the process control board 20. Should a sufficient amount of leaked water, 3 ounces for example, collect within the pan 62, the float 64 is raised sufficiently to trigger/close the switch and thereby provide a signal to the normally open, solenoid valve 18. The solenoid valve 18 is coupled to the inlet passageway/conduit 48 of the manifold 28 and, in response the signal, closing of the solenoid valve 18 effectuates closing of the inlet passageway/conduit 48. As a result of the closing of the inlet passageway/conduit 48, flow through the manifold 28 is stopped and the flow sensor will indicate a no flow condition, whereby the process control board 20 will de-energize any of the heating elements 34, 36 that were operating because of the indication of a flow condition. Furthermore, the process control board 20 will disable the entire ETW heater 10 until the heater 10 has been serviced.

The ETW heater 10 additionally incorporates a pressure sensor 66 located along the flow path 30. Many building codes mandate that pressure in water lines of a building must be maintained at 80 psi or lower. The pressure sensor 66 is coupled to the process control board 20 and is normally in the open position. Upon detecting a high pressure in the system, the pressure sensor 66 is closed and a signal provided to the process control board 20, which in turn may provide a signal to a building management system as further discussed. Since pressure sensors are well known in the industry, pressure sensor 66 is not further discussed herein.

Since the heating elements 34, 36 are operated on 110 v to 480 v AC, the system 60 incorporates a transformer 68 to step down the voltage to 24 v AC for operation of the solenoid valve 18 through the closing of the switch in the float 64 and for supplying the signal upon closing of the pressure sensor 66.

In addition to energizing the solenoid valve 18, the signal from the float may be relayed to the process control board 20 to trigger an audible alarm or speaker 70, which may emit a loud "chirp" noise. Once an operator has been alerted to the leak condition, the operator is prompted to cut off of power and water to the heater 10

Once the ETW heater 10 has been serviced, or once power and water have been shut off, the system 60 may be manually reset through activation of a reset button 72, provided on the process control board 20 and accessible through a removeable panel 74 on the front of the housing 12.

The ETW heater 10 and process control board 20 can also be provided with building management system (BMS) capabilities. In this regard, the process control board 20 may include 6 pin outputs to feed appropriate signals to the BMS form various sensors included in the ETW heater 10, some of which have been discussed above.

For example, the pins can provide 0-10 vdc outputs to the BMS signaling operating conditions for the ETW heater 10 as follows:

| | | |
|---|---|---|
| Pin 1 | Solenoid Water Leak | 0 v = dry and 10 vdc = Wet/Leak |
| Pin 2 | Heater On/Off | 0 v = Off and 10 vdc = On |
| Pin 3 | kW | 0 v = 0 and 10 vdc = digital count 255 |
| Pin 4 | Temperature output | Conversion Chart of DegF to vdc |
| Pin 5 | Pressure Sensor Switch | 0 v = open and 10 vdc = High Pressure |
| Pin 6 | | common |

As a person skilled in the art will really appreciate, the above description is meant as an illustration of at least one implementation of the principles of the present invention. This description is not intended to limit the scope or application of this invention since the invention is susceptible to modification, variation and change without departing from the spirit of this invention, as defined in the following claims.

I claim:

1. A tankless water heater for heating a continuous supply of water, the tankless water heater comprising:

a housing defining an enclosure;

a water inlet port;

a water outlet port;

a heater assembly located within the housing, the heater assembly including a body defining a water flow path coupled to the water inlet port and the water outlet port; at least one heating element located within the water flow path;

a flow sensing device configured to measure a flow condition of water between the water inlet port and the water outlet port; and a leak detection system, the leak detection system including a defined water collection area formed by a portion of the housing and configured to retain collected water therein, a water sensor positioned adjacent to the defined water collection area and configured to detect the presence of water therein, the water sensor being coupled to a water stoppage valve moveable between an open position and a closed position, in the open position the water stoppage valve being configured to permit the flow of water from the inlet port to the outlet port, in the closed position the water stoppage valve being configured to prevent the flow of water from the inlet port to the outlet port, the water stoppage valve being configured to move from the open position to the closed position in response to a signal from the water sensor indicating water being present in the defined water collection area.

2. The tankless water heater according to claim 1, wherein the water stoppage valve is a solenoid valve.

3. The tankless water heater according to claim 2, wherein the solenoid valve is biased in the open position.

4. The tankless water heater according to claim 1, wherein the water sensor is one of an optical level switch, a capacitance level sensor, an ultrasonic level sensor, a conductivity level sensor and a float switch.

5. The tankless water heater according to claim 1, wherein the defined water collection area is a collection pan formed in a bottom wall of the housing.

6. The tankless water heater according to claim 1, wherein the defined water collection area is a collection pan formed by an upwardly concave portion of the housing.

7. The tankless water heater according to claim 6, wherein the water sensor is a mechanical float sensor.

8. The tankless water heater according to claim 1, wherein the water sensor is positioned centrally within the defined water collection area.

9. The tankless water heater according to claim 1, further comprising a process control board, the process control board being coupled to the water sensor and water stoppage valve and being configured to de-energize the heating element upon generation of a signal by the water sensor indicating water being present in the defined water collection area.

10. The tankless water heater according to claim 9, wherein the process control board is configured to prevent energizing of the heating elements until a reset condition is established.

11. The tankless water heater according to claim 10, further comprising a reset button coupled to the process control board, upon activation of the reset button the process control board being configured to establish the reset condition.

12. The tankless water heater according to claim 9, wherein the process control board is configured to provide a status output to a building management system.

13. The tankless water heater according to claim 12, wherein the status output includes dry and wet/leak status indication.

14. The tankless water heater according to claim 12, wherein the status output includes at least one of dry and wet/leak status indication and heater on and off status indication.

15. The tankless water heater according to claim 12, wherein the status output includes at least one of water temperature status and water pressure status.

16. The tankless water heater according to claim 1, further comprising an audible alarm coupled to the water sensor and water stoppage valve and being configured to produce an audible signal upon generation of a signal by the water sensor indicating water being present in the defined water collection area.

17. The tankless water heater according to claim 1, further comprising a step down transformer.

18. The tankless water heater according to claim 17, wherein the step down transformer is coupled to the water stoppage valve.

* * * * *